US006095906A

United States Patent [19]

Wang

[11] Patent Number: 6,095,906

[45] Date of Patent: Aug. 1, 2000

[54] SANDER DEVICE HAVING HORIZONTAL AND VERTICAL SANDER MEMBERS

[76] Inventor: Tian Wang Wang, No. 45, Yi Chang East Road, Taiping City, Taichung Hsien, Taiwan, 411

[21] Appl. No.: 09/435,680

[22] Filed: Nov. 8, 1999

[51] Int. Cl.[7] ..... B24B 7/00; B24B 9/00

[52] U.S. Cl. ..... 451/65; 451/340

[58] Field of Search ..... 451/65, 451, 452, 451/453, 454, 455, 223, 195, 220, 48, 340

[56] References Cited

U.S. PATENT DOCUMENTS

| | | | |
|---|---|---|---|
| 2,948,088 | 8/1960 | Jepson | 451/65 |
| 3,088,248 | 5/1963 | Strzoda | 451/65 |
| 4,305,231 | 12/1981 | Rasmussen | 451/65 |
| 5,168,656 | 12/1992 | Jolly et al. | 451/65 |
| 5,199,220 | 4/1993 | Steiner et al. | 451/65 |
| 5,505,655 | 4/1996 | Haffely et al. | 451/65 |
| 5,725,418 | 3/1998 | Giebmanns | 451/65 |

*Primary Examiner*—Derris H. Banks
*Attorney, Agent, or Firm*—Charles E. Baxley

[57] ABSTRACT

A sander device includes a motor, a sander member secured to a spindle of the motor, and one or more further sander members coupled to the motor and driven by the motor. A shaft is rotatable secured beside the motor and coupled to and driven by the motor for slidably supporting the further sander members. A follower is slidably engaged on the shaft for supporting the further sander members and is driven by the motor by cranks and links. The follower includes a guiding rod for preventing the follower from rotating relative to the shaft.

13 Claims, 5 Drawing Sheets

SANDER DEVICE HAVING HORIZONTAL AND VERTICAL SANDER MEMBERS

BACKGROUND OF THE INVENTION

1. Field of the Invention

The present invention relates to a sander, and more particularly to a sander device having one or more horizontal and one or more vertical sander members.

2. Description of the Prior Art

Typical sanders comprise a motor coupled to a sander member only, for driving the single sander member to conduct sanding operations. The motor may not be used to drive two or more sander members, and particularly, the motor may not be used to drive two or more sander members of different directions.

The present invention has arisen to mitigate and/or obviate the afore-described disadvantages of the conventional sanders.

SUMMARY OF THE INVENTION

The primary objective of the present invention is to provide a sander device including a motor coupled to one or more horizontal sander members and one or more vertical sander members for driving the sander members.

In accordance with one aspect of the invention, there is provided a sander device comprising a motor including a spindle, a first sander member secured to the spindle and driven by the motor, a housing disposed beside the motor, at least one second sander member supported in the housing, and means for coupling the motor to the second sander member and to drive the second sander member.

A base is further provided for supporting the motor and the housing. A work table is secured on the base and provided beside the first sander member and adjustably secured on the base for supporting the work pieces to be sanded by the first sander member.

The coupling means includes a shaft rotatably secured in the housing and coupled to and driven by the motor, the second sander member being slidably engaged on the shaft, and means for moving the second sander member along the shaft.

The coupling means further includes a follower slidably engaged on the shaft for supporting the second sander member. The moving means includes a first worm gear provided on the shaft, a second worm gear rotatably supported on the housing at a pivot pole and engaged with the first worm gear, and means for connecting the second worm gear to the follower to move the follower relative to the shaft. The connecting means includes at least one crank secured to the pivot pole of the second worm gear, and at least one link coupling the crank to the follower and to move the follower relative to the shaft. A casing is secured on the housing for rotatably receiving the second worm gear.

A guiding device is further provided for guiding the follower to move relative to the shaft. The housing includes a board provided thereon, the guiding means includes a rod secured to the follower and slidably engaged through the board for guiding the follower to move relative to the shaft and for preventing the follower from rotating relative to the shaft.

The shaft includes a first bevel gear provided thereon, the spindle of the motor includes a second bevel gear coupled to the first bevel gear for driving the shaft via the first and the second bevel gears.

Another work table is secured on the housing and provided beside the second sander member and adjustably secured on the housing for supporting the work pieces to be sanded by the second sander member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
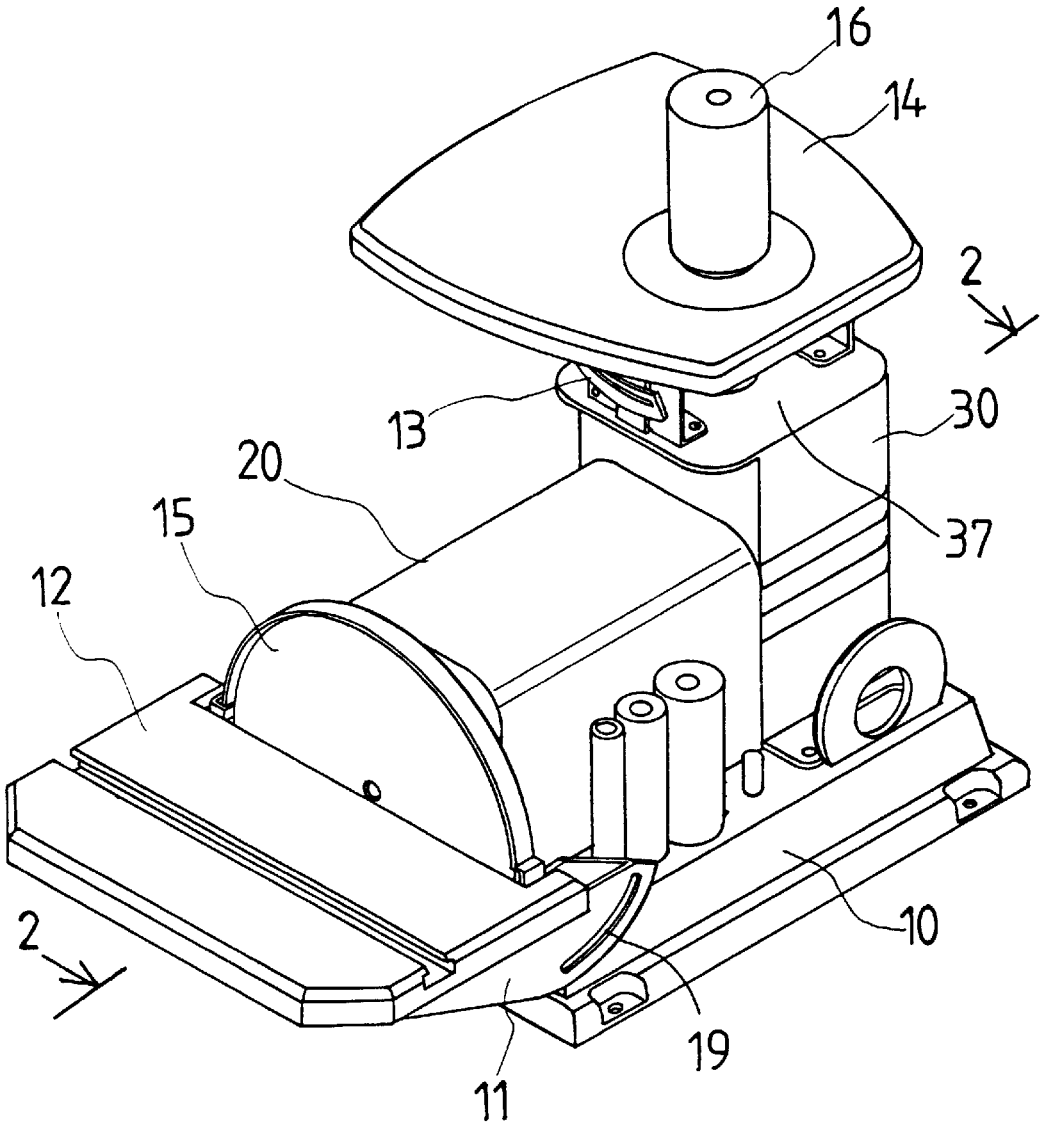
FIG. 1 is a perspective view of a sander device in accordance with the present invention.
Figure 2:
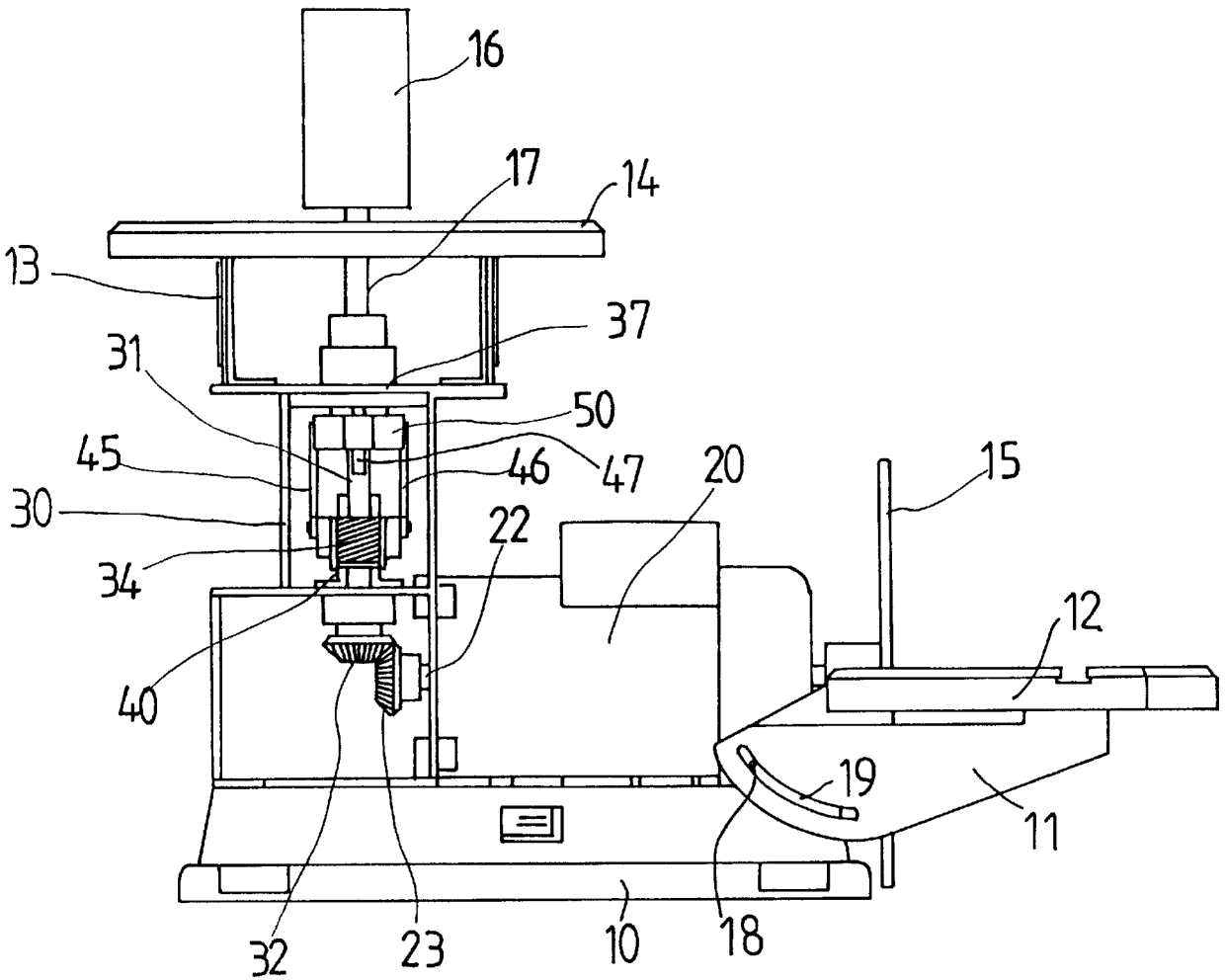
FIG. 2 is a cross sectional view taken along lines 2—2 of FIG. 1.
Figure 3:
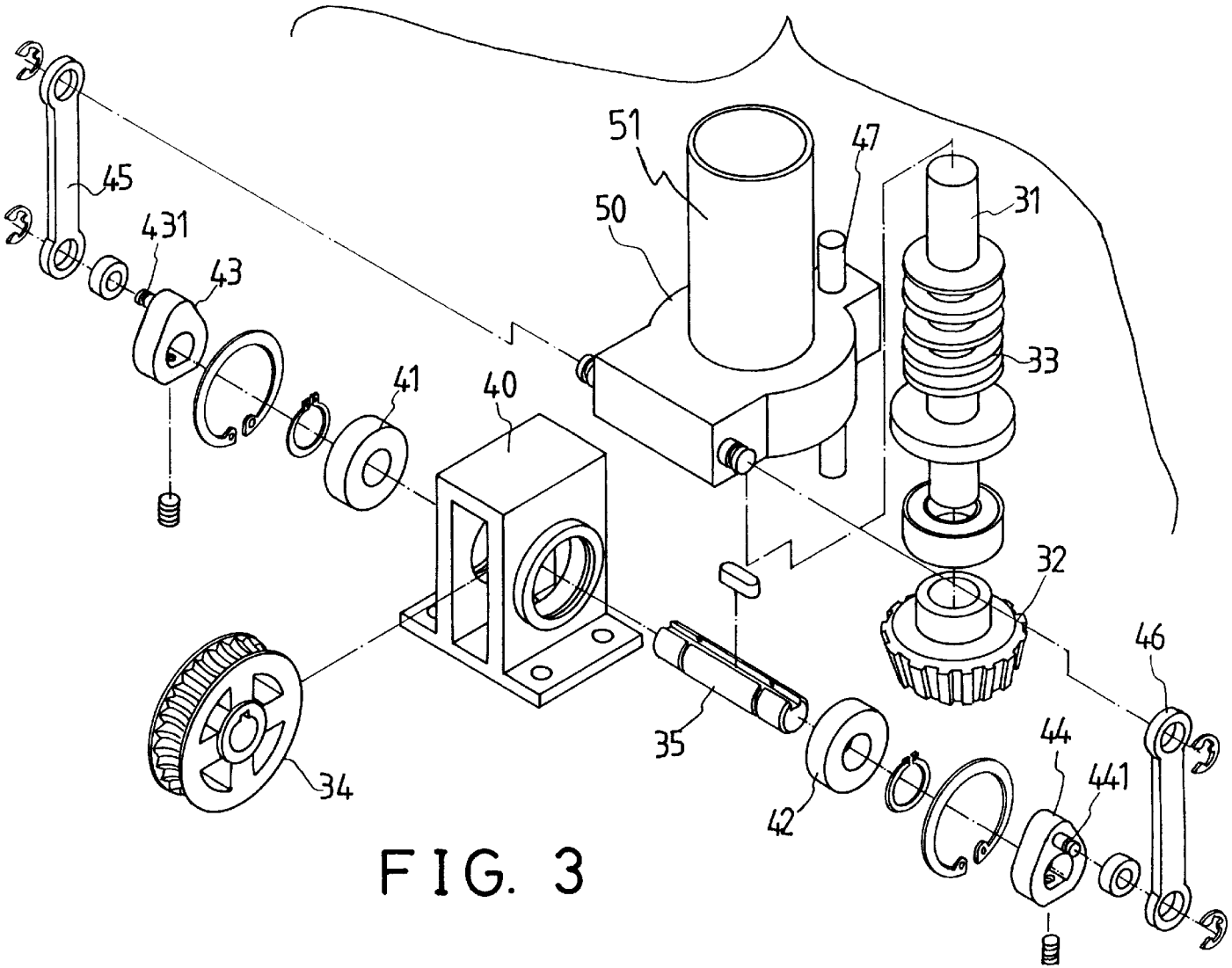
FIG. 3 is a partial exploded view showing a coupling mechanism for a vertical sander member of the sander device.
Figure 4:
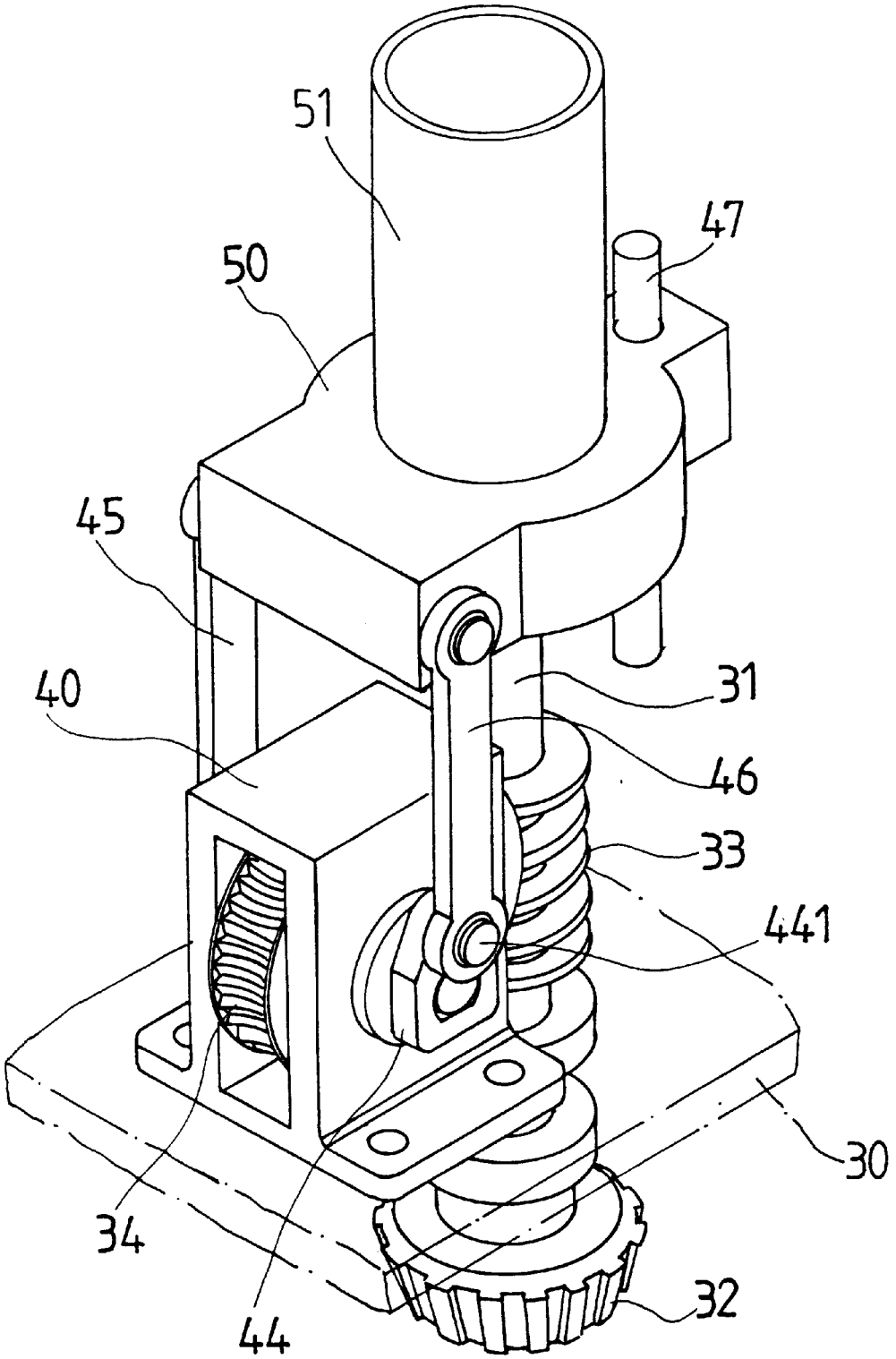
FIG. 4 is a partial perspective view illustrating the coupling mechanism for the vertical sander member of the sander device.

Referring to the drawings, and initially to FIGS. 1 and 2, a sander device in accordance with the present invention comprises a base 10, a motor 20 disposed on the base 10, particularly on the middle portion of the base 10. The motor 20 includes a spindle 22 rotatably provided therein and having two ends extended outward of the motor 20. A grinding disc or a sander member 15 is secured to one end of the spindle 22, and a bevel gear 23 is secured to the other end of the spindle 22. A work table 12 includes one or more adjusting plates 11 secured thereto and adjustably secured to the base 10 with a typical sliding engagement of a fastener 18 along a curved groove 19 of the plate 11, for allowing the work table 12 to be adjusted to any selected or suitable angular position relative to the base 10. The work table 12 is provided beside the sander member 15 for supporting the work pieces to be sanded with the sander member 15 which is typically called as the horizontal sander member.

Figure 5:
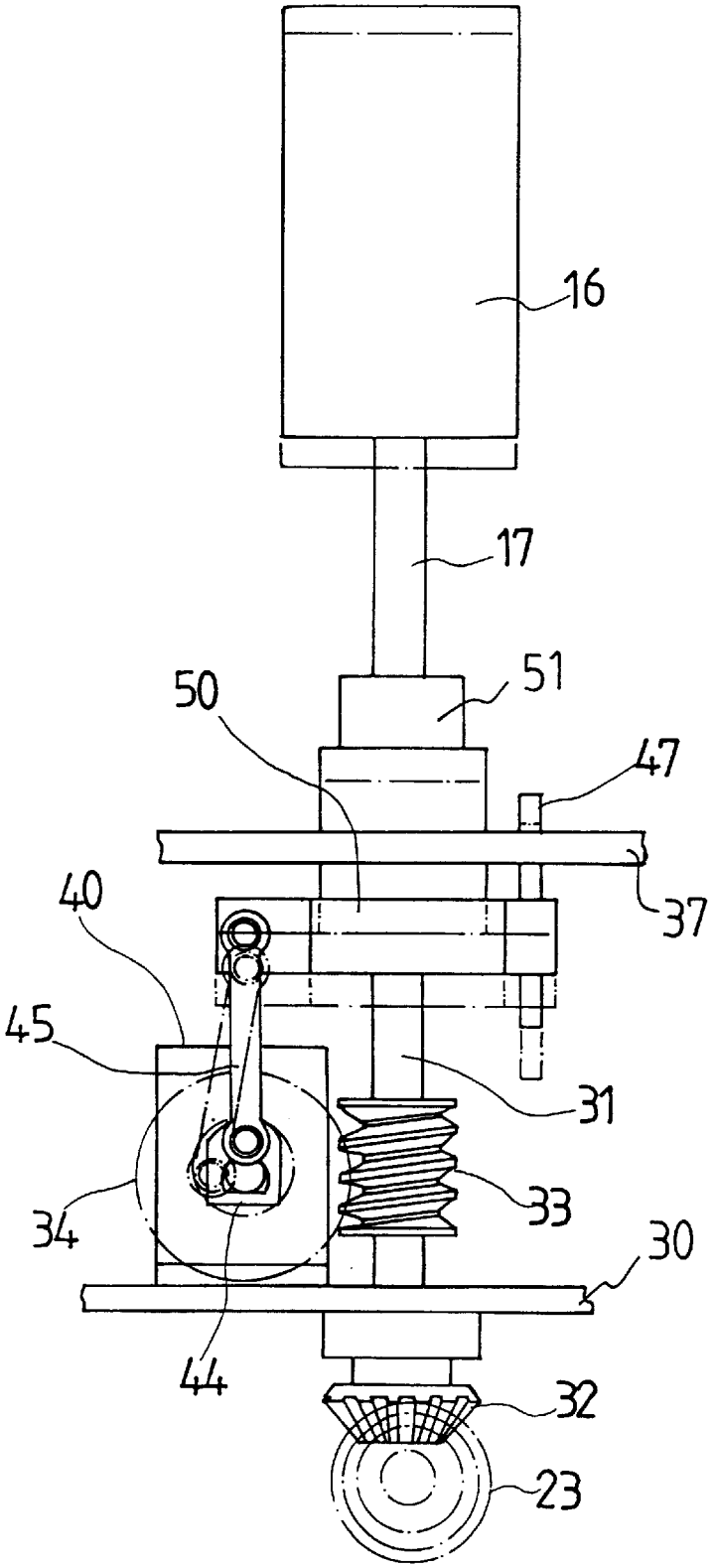
FIG. 5 is a plane view illustrating the operation of the coupling mechanism for the vertical sander member of the sander device.

A housing 30 is disposed on the base 10 and disposed beside the motor 20, opposite to the sander member 15, and includes a board 37 provided on top thereof (FIGS. 2, 5). As best shown in FIGS. 2–5, a shaft 31 is rotatably secured in the housing 30 and is vertical to the base 10 or is extended upward relative to the base 10. The shaft 31 includes a bevel gear 32 secured to the bottom and engaged with the bevel gear 23 of the spindle 22 such that the shaft 31 may also be driven and rotated by the motor 20 simultaneously. The shaft 31 includes a worm gear 33 provided thereon, such as on the middle portion thereof. A follower 50 is slidably engaged on the upper portion of the shaft 31 and includes a rod 47 secured thereto and slidably engaged through the board 37 of the housing 30 for guiding the follower 50 to move up and down relative to the shaft 31 and for preventing the follower 50 from rotating relative to the shaft 31 (FIG. 5). The follower 50 includes a hub or a barrel 51 provided thereon for supporting and securing an axle 17 of another sander member 16 with such as fastener devices, such that the sander member 16 may be moved in concert with the follower 50 and may he moved tip and down along the shaft 31, such that the sander member 16 may be called as a vertical sander member.

A casing 40 is secured on the housing 30 by fasteners for rotatably receiving a worm gear 34 with hearings 41, 42. The worm gear 34 is secured on a pivot pole 35 by such as keys and is engaged with the worm 46. The follower 50 and thus the sander member 16 may be moved up and down along the shaft 31 by the worm gear 34 via the cranks 43, 44 and the links 45, 46 when the worm gear 34 is driven by the motor 20, best shown in FIG. 5. Another work table 14 includes one or more adjusting plates 13 secured thereto and adjustably secured to the board 37 of the housing 30 with a typical sliding engagement of a fastener along a curved groove of the plate 13, for allowing the work table 14 to be adjusted to any selected or suitable angular position relative to the housing 30. The work table 14 is provided below the sander member 16 for supporting the work pieces to be sanded with the sander member 16.

In operation, as shown in FIG. 2, the horizontal sander member 15 may be directly driven by the motor 20. The vertical sander member 16 may be moved up and down relative to or along the shaft 31 by the motor 20 via the bevel gears 23, 32 and the worm gears 33, 34 and the cranks 43, 44 and the links 45, 46.

Alternatively, a clutch device may be provided between the motor 20 and the sander member 16 for selectively coupling the sander member 16 to the motor 20 and for allowing the sander member 16 to be selectively driven by the motor 20 when required. For example, the casing 40 and/or the worm gear 34 may be selectively disengaged from the worm gear 33 by the clutch device or by a sliding mechanism; or the bevel gear 32 may be selectively disengaged from the bevel gear 23 by the clutch device or by a sliding mechanism. The cranks 43, 44 may also be selectively coupled to the follower 50 when required, such that the vertical sander member 16 may or may not be simultaneously driven by the motor 20 when the horizontal sander member 15 is driven by the motor 20.

Accordingly, the sander device in accordance with the present invention includes a motor coupled to one or more horizontal sander members and one or more vertical sander members for driving the sander members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sander device comprising:

a motor including a spindle, a first sander member secured to said spindle and driven by said motor, a housing disposed beside said motor, at least one second sander member supported in said housing, and means for coupling said motor to said at least one second sander member and to drive said at least one second sander member, wherein said coupling means includes a shaft rotatably secured in said housing and coupled to and driven by said motor, said at least one second sander member being slidably engaged on said shaft, and means for moving said at least one second sander member along said shaft.

2. The sander device according to claim 1 further comprising a base for supporting said motor and said housing.

3. The sander device according to claim 2 further comprising a work table secured on said base and provided beside said first sander member.

4. The sander device according to claim 3 further comprising means for adjustably securing said work table on said base.

5. The sander device according to claim 1, wherein said coupling means further includes a follower slidably engaged on said shaft for supporting said at least one second sander member.

6. The sander device according to claim 5, wherein said moving means includes a first worm gear provided on said shaft, a second worm gear rotatably supported on said housing at a pivot pole and engaged with said first worm gear, and means for connecting said second worm gear to said follower to move said follower relative to said shaft.

7. The sander device according to claim 6, wherein said connecting means includes at least one crank secured to said pivot pole of said second worm gear, and at least one link coupling said at least one crank to said follower and to move said follower relative to said shaft.

8. The sander device according to claim 6 further comprising a casing secured on said housing for rotatable receiving said second worm gear.

9. The sander device according to claim 5 further comprising means for guiding said follower to move relative to said shaft.

10. The sander device according to claim 9, wherein said housing includes a board provided thereon, said guiding means includes a rod secured to said follower and slidably engaged through said board for guiding said follower to move relative to said shaft and for preventing said follower from rotating relative to said shaft.

11. The sander device according to claim 1, wherein said shaft includes a first bevel gear provided thereon, said spindle of said motor includes a second bevel gear coupled to said first bevel gear for driving said shaft via said first and said second bevel gears.

12. The sander device according to claim 1 further comprising a work table secured on said housing and provided beside said second sander member.

13. The sander device according to claim 12 further comprising means for adjustably securing said work table on said housing.

* * * * *